US007658015B1

(12) United States Patent
Gardell

(10) Patent No.: US 7,658,015 B1
(45) Date of Patent: Feb. 9, 2010

(54) CLOTHES DRYING DEVICE

(76) Inventor: Christopher M. Gardell, 351 Broad St., Newark, NJ (US) 07104

( * ) Notice: Subject to any disclaimer, the term of this patent is extended or adjusted under 35 U.S.C. 154(b) by 0 days.

(21) Appl. No.: 11/748,870

(22) Filed: May 15, 2007

(51) Int. Cl.
*F26B 19/00* (2006.01)

(52) U.S. Cl. ..... 34/90; 34/92; 34/595; 34/603; 34/602; 34/210; 34/218; 34/242; 68/20; 8/159

(58) Field of Classification Search ..... 34/90, 34/92, 595, 603, 610, 210, 218, 242; 8/158, 8/159; 68/20, 24
See application file for complete search history.

(56) References Cited

U.S. PATENT DOCUMENTS 2,114,776 A * 4/1938 Davis ..... 68/18 R
2,310,680 A * 2/1943 Dinley ..... 34/74
2,316,669 A * 4/1943 Busi ..... 68/20
2,495,535 A * 1/1950 Morrison ..... 34/76
2,573,966 A * 11/1951 Hamlin ..... 8/142
2,657,475 A * 11/1953 Erickson ..... 34/139
2,686,372 A * 8/1954 Graham ..... 34/75
2,686,373 A * 8/1954 Erickson ..... 34/75
2,701,421 A * 2/1955 Erickson et al. ..... 34/530
2,717,456 A * 9/1955 Smith ..... 34/75
2,720,037 A * 10/1955 Erickson ..... 34/526
2,724,906 A * 11/1955 Phleider ..... 34/75
2,728,481 A * 12/1955 Robinson et al. ..... 220/4.02
2,742,708 A * 4/1956 McCormick ..... 34/76
2,758,461 A * 8/1956 Tann ..... 68/19.1
2,777,313 A * 1/1957 Dodge ..... 68/20
2,814,130 A * 11/1957 Cayot ..... 34/82
2,827,276 A * 3/1958 Racheter ..... 432/62
2,851,791 A * 9/1958 Olthuis ..... 34/90
2,858,688 A * 11/1958 Smith ..... 68/20
2,865,111 A * 12/1958 Geldhof ..... 34/95
2,875,996 A * 3/1959 Hullar ..... 432/67
2,913,832 A * 11/1959 Kaufman ..... 34/80
2,925,665 A * 2/1960 Smith ..... 34/82
2,927,379 A * 3/1960 Tann ..... 34/95
2,929,674 A * 3/1960 Tann ..... 8/159
2,941,308 A * 6/1960 Cobb et al. ..... 34/552
2,958,138 A * 11/1960 Ashby ..... 34/601
2,958,139 A * 11/1960 Smith ..... 34/604
2,958,140 A * 11/1960 Smith ..... 34/598
2,959,867 A * 11/1960 Doty ..... 34/82
2,996,809 A * 8/1961 Shapter ..... 34/75
3,027,653 A * 4/1962 Long et al. ..... 34/86

(Continued)

FOREIGN PATENT DOCUMENTS

GB 2272753 * 5/1994

(Continued)

*Primary Examiner*—Stephen M. Gravini

(57) ABSTRACT

A clothes drying device for using a vacuum to dry clothes includes a housing being positioned on a support surface. The housing includes a top wall, a bottom wall and a perimeter wall extending between the bottom wall and the top wall to define an interior space of the housing. A drum assembly is mounted in the interior space of the housing. The drum assembly receives clothes to be dried. A hole in the perimeter wall of the housing is in communication with the drum assembly to allow the clothes to be placed in the drum assembly. A vacuum pump is mounted in the interior space of the housing. The vacuum pump is in fluid communication with drum assembly to create a vacuum in the drum assembly to draw moisture out of the clothes in the drum assembly.

10 Claims, 4 Drawing Sheets

U.S. PATENT DOCUMENTS 3,043,015 A * 7/1962 Brucken ..... 34/80
3,066,423 A * 12/1962 Solem ..... 34/86
3,139,633 A * 7/1964 Fecho et al. ..... 8/158
3,173,767 A * 3/1965 Gerald ..... 34/82
3,198,903 A * 8/1965 Chafee, Jr. ..... 335/152
3,229,382 A * 1/1966 Lambert ..... 34/538
3,231,909 A * 2/1966 Candor ..... 8/159
3,266,167 A * 8/1966 Finnegan ..... 34/543
3,273,256 A * 9/1966 Behrens ..... 34/546
3,292,347 A * 12/1966 Hodgkinson ..... 261/83
3,358,301 A * 12/1967 Candor et al. ..... 8/159
3,358,302 A * 12/1967 Candor ..... 8/159
3,387,385 A * 6/1968 Mandarino, Jr. et al. ..... 34/596
3,475,829 A * 11/1969 Brinkman et al. ..... 34/543
3,639,998 A * 2/1972 Mason ..... 34/82
3,698,098 A * 10/1972 Ramsay ..... 34/403
3,718,982 A * 3/1973 Deaton ..... 34/82
4,041,614 A * 8/1977 Robinet ..... 34/92
4,057,907 A * 11/1977 Rapino et al. ..... 34/261
4,257,173 A 3/1981 Smith
4,268,247 A * 5/1981 Freze ..... 432/21
4,305,211 A * 12/1981 Peterson ..... 34/92
4,314,409 A * 2/1982 Cartier et al. ..... 34/82
4,467,530 A * 8/1984 Fesmire et al. ..... 34/313
4,507,080 A * 3/1985 Freze ..... 432/105
4,615,125 A * 10/1986 Wyborn ..... 34/92
4,700,492 A * 10/1987 Werner et al. ..... 34/403
D292,630 S 11/1987 Nagai et al.
5,097,606 A * 3/1992 Harmelink et al. ..... 34/467
5,131,169 A * 7/1992 Jaster ..... 34/398
5,220,734 A * 6/1993 Carver ..... 34/600
5,291,667 A * 3/1994 Joslin et al. ..... 34/526
5,709,040 A * 1/1998 Horwitz ..... 34/565
5,724,750 A * 3/1998 Burress ..... 34/267
6,067,730 A * 5/2000 Woods ..... 34/603
6,088,932 A * 7/2000 Adamski et al. ..... 34/274
6,094,763 A * 8/2000 Engel ..... 8/159
6,151,795 A * 11/2000 Hoffman et al. ..... 34/92
6,184,193 B1 * 2/2001 Yamada ..... 510/291
6,324,771 B1 * 12/2001 McAllister et al. ..... 34/595
6,370,798 B1 * 4/2002 Gonzalez, Sr. ..... 34/595
6,434,857 B1 * 8/2002 Anderson et al. ..... 34/595
6,868,621 B1 * 3/2005 Grimm et al. ..... 34/92
7,055,262 B2 * 6/2006 Goldberg et al. ..... 34/86
2002/0069465 A1 * 6/2002 Chute et al. ..... 8/158
2003/0000106 A1 * 1/2003 Anderson et al. ..... 34/598
2004/0123489 A1 * 7/2004 Pancheri et al. ..... 34/597
2004/0255394 A1 * 12/2004 Mani et al. ..... 8/159
2005/0005649 A1 * 1/2005 Monteiro ..... 68/13 R
2006/0179676 A1 * 8/2006 Goldberg et al. ..... 34/77
2006/0218812 A1 * 10/2006 Brown ..... 34/86
2008/0022550 A1 * 1/2008 Masters ..... 34/480
2008/0110044 A1 * 5/2008 Ehlers ..... 34/524
2009/0000139 A1 * 1/2009 Hodges ..... 34/86

FOREIGN PATENT DOCUMENTS

GB 2272753 A * 5/1994

* cited by examiner

CLOTHES DRYING DEVICE

BACKGROUND OF THE INVENTION

1. Field of the Invention

The present invention relates to clothes dryers and more particularly pertains to a new clothes dryer for using a vacuum to dry clothes.

2. Description of the Prior Art

The use of clothes dryers is known in the prior art. While these devices fulfill their respective, particular objectives and requirements, the need remains for a device that has certain improved features that detects a moisture level in the air being vacuumed from the device to turn off the device when the moisture level is below a predetermined level. Additionally, the device should include a heating element to maintain a minimal operating temperature in the device.

SUMMARY OF THE INVENTION

The present invention meets the needs presented above by generally comprising a housing being positioned on a support surface. The housing includes a top wall, a bottom wall and a perimeter wall extending between the bottom wall and the top wall to define an interior space of the housing. A drum assembly is mounted in the interior space of the housing. The drum assembly receives clothes to be dried. A hole in the perimeter wall of the housing is in communication with the drum assembly to allow the clothes to be placed in the drum assembly. A vacuum pump is mounted in the interior space of the housing. The vacuum pump is in fluid communication with drum assembly to create a vacuum in the drum assembly to draw moisture out of the clothes in the drum assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
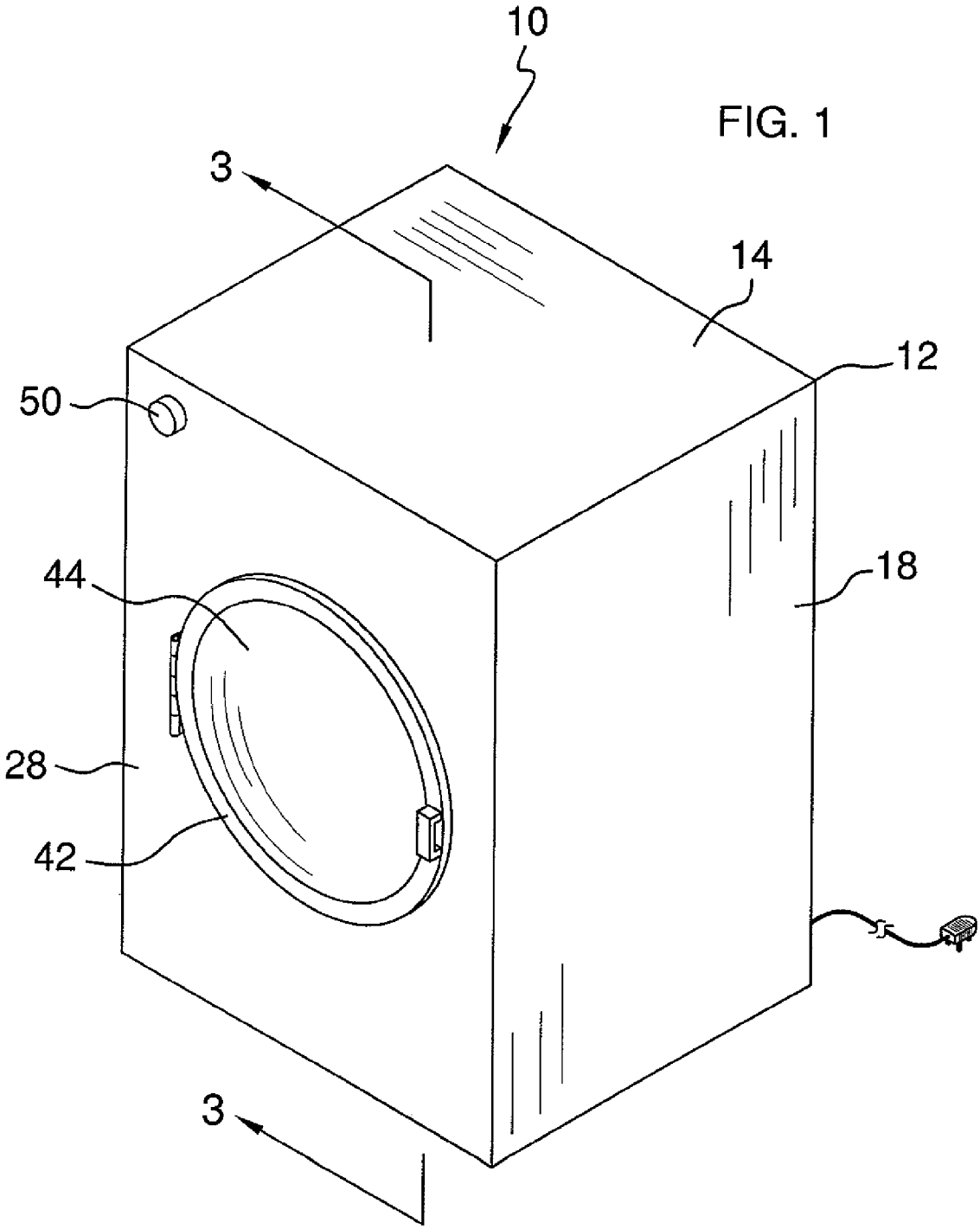
FIG. 1 is a perspective view of a clothes drying device according to the present invention.
Figure 2:
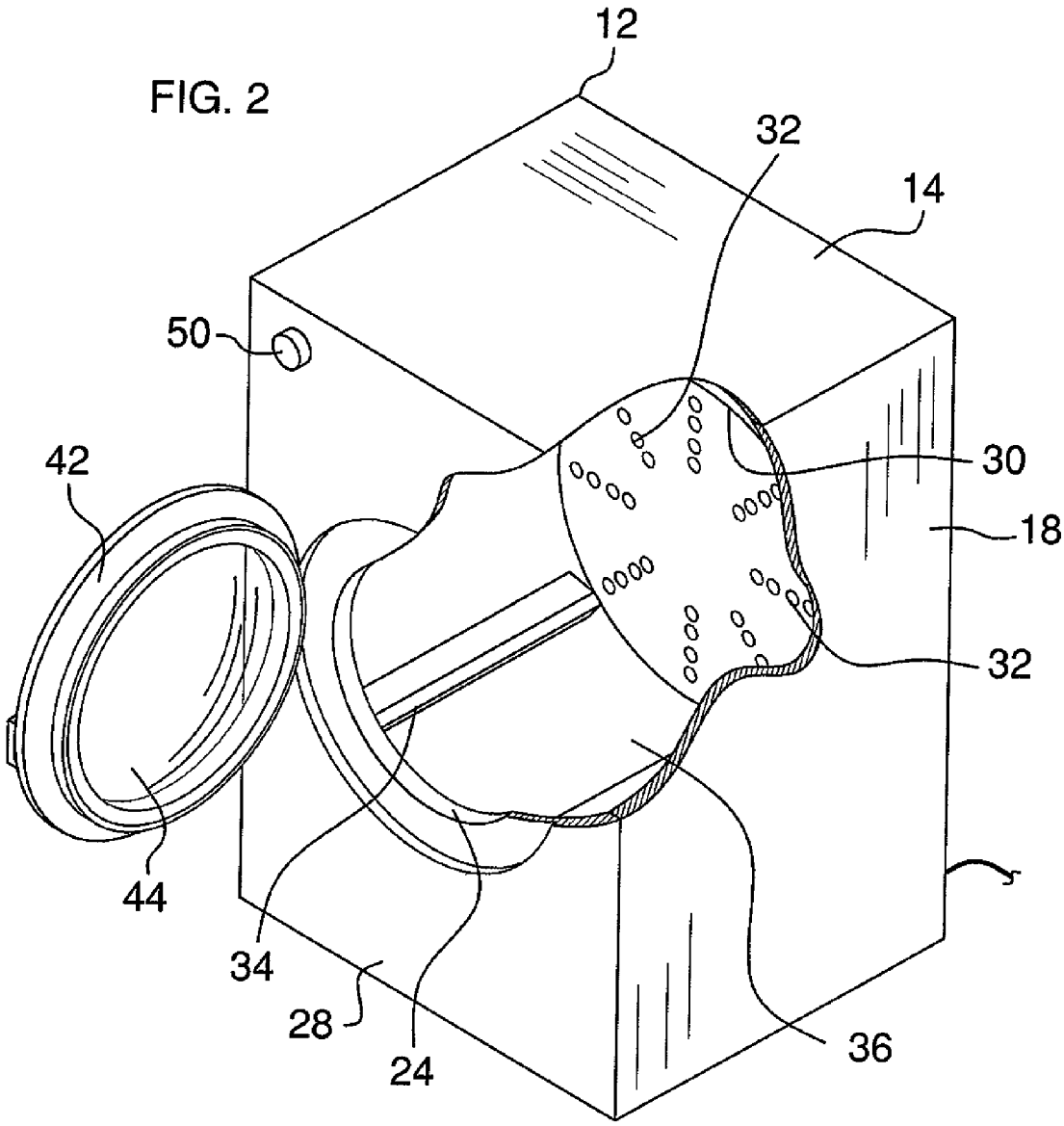
FIG. 2 is a perspective view of the present invention with the door open and portion of the housing and drum assembly shown broken away.
Figure 3:
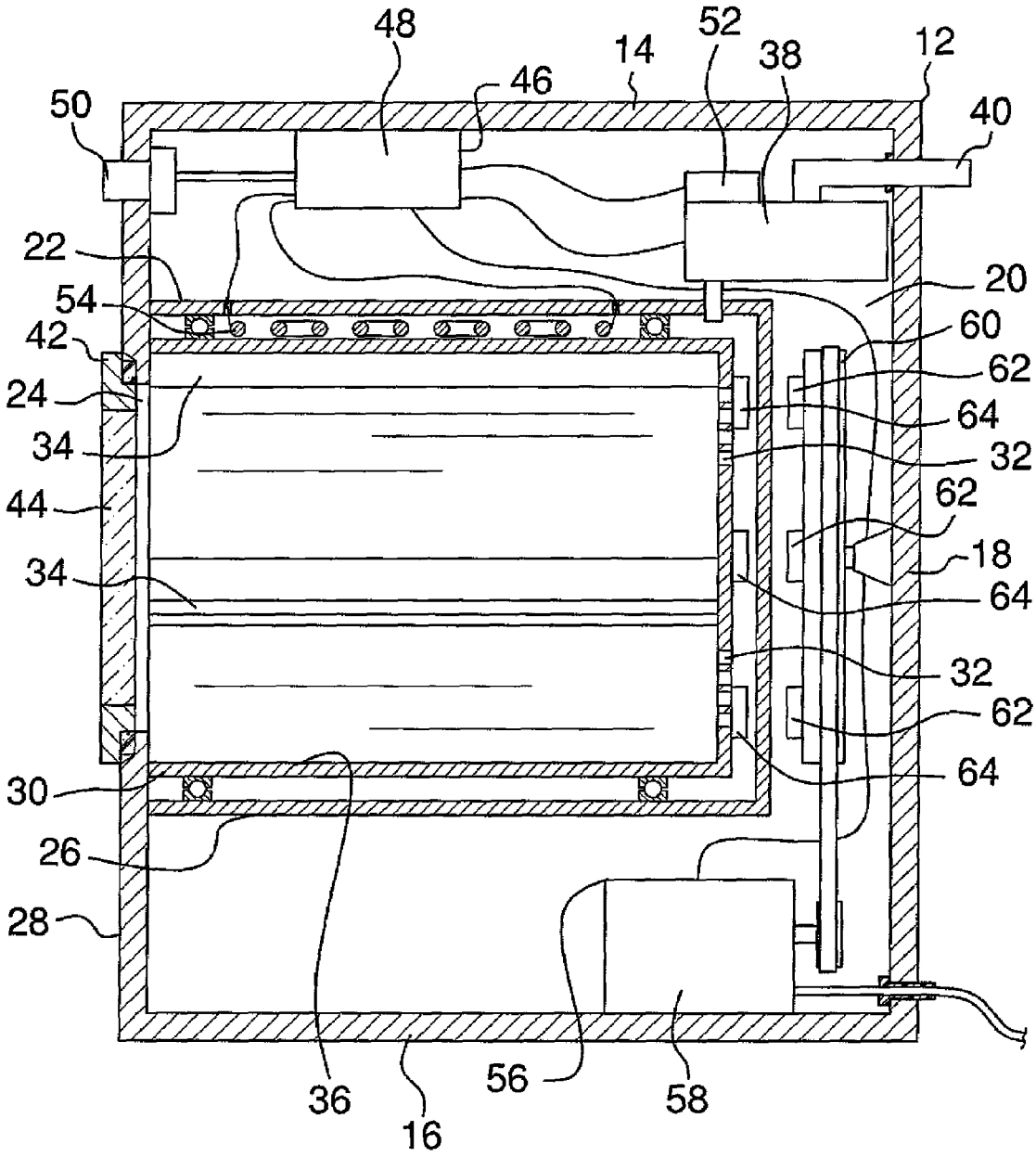
FIG. 3 is a cross-sectional view of the present invention taken along line 3-3 of FIG. 1.
Figure 4:
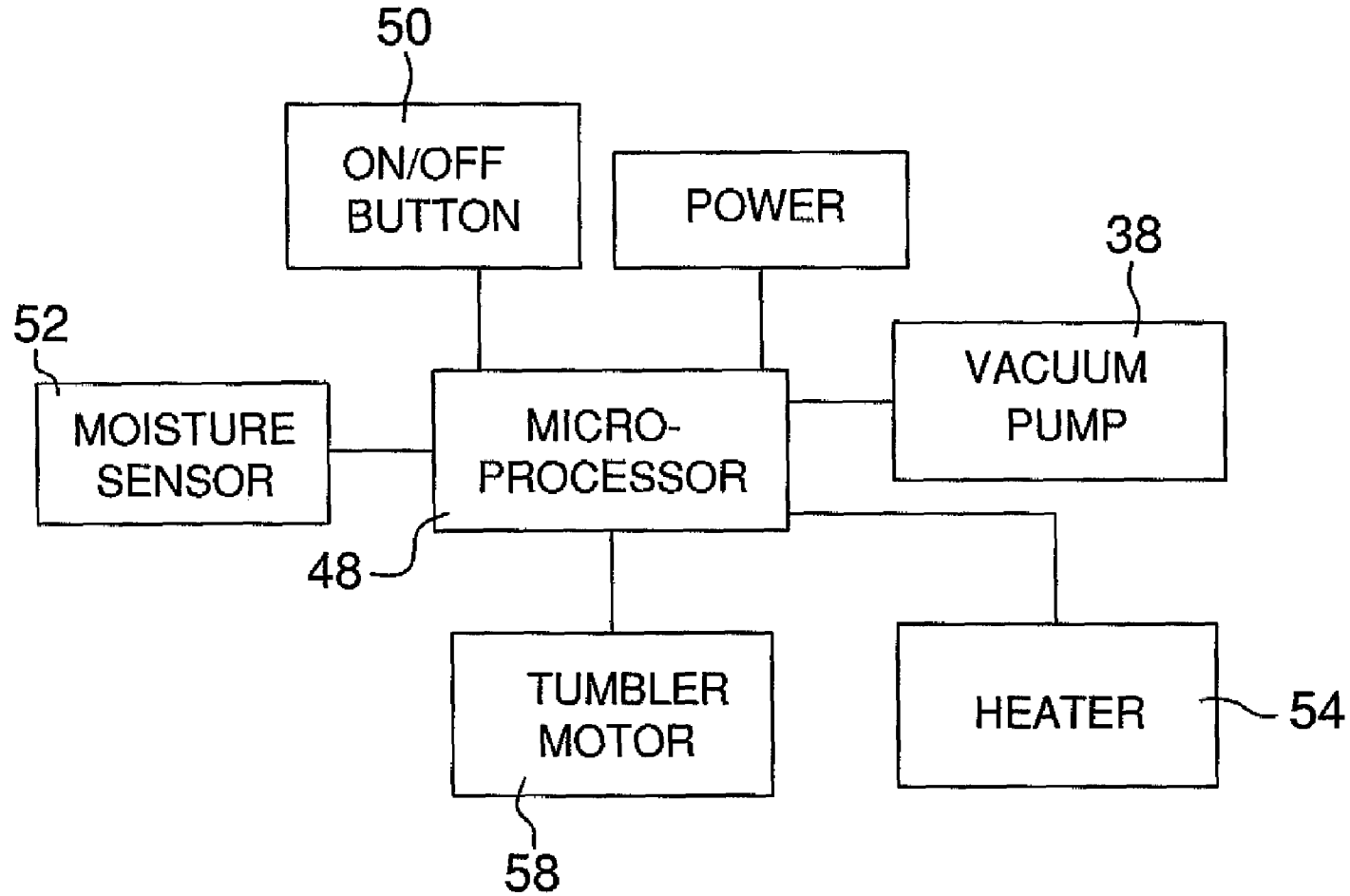
FIG. 4 is a schematic view of the present invention.

With reference now to the drawings, and in particular to FIGS. 1 through 4 thereof, a new clothes dryer embodying the principles and concepts of the present invention and generally designated by the reference numeral 10 will be described.

As best illustrated in FIGS. 1 through 4, the clothes drying device 10 generally comprises a housing 12 being positioned on a support surface. The housing 12 includes a top wall 14, a bottom wall 16 and a perimeter wall 18 extending between the bottom wall 16 and the top wall 14 to define an interior space 20 of the housing 12. A drum assembly 22 is mounted in the interior space 20 of the housing 12. The drum assembly 22 receives clothes to be dried. A hole 24 in the perimeter wall 18 of the housing 12 is in communication with the drum assembly 22 to allow the clothes to be placed in the drum assembly 22.

The drum assembly 22 includes a sealed chamber 26 positioned in the interior space 20 of the housing 12. The sealed chamber 26 is mounted to the perimeter wall 18 of the housing 12 and extends into the interior space 20 from the perimeter wall 18. The sealed chamber 26 extends into the interior space 20 from a front wall 28 of the perimeter wall 18. A tumbling drum 30 is positioned in the sealed chamber 26 and extends around the hole 24. The tumbling drum 30 is rotatably mounted to the sealed chamber 26 and receives the clothes to be dried through the hole 24. The tumbling drum 30 has a plurality of apertures 32 extending therethrough to permit fluid communication with the sealed chamber 26. A plurality of tumbling bars 34 is coupled to an interior surface 36 of the tumbling drum 30 and extends along a length of the tumbling drum 30. The tumbling bars 34 impact and tumble the clothes in the tumbling drum 30 when the tumbling drum 30 is rotated.

A vacuum pump 38 is mounted in the interior space 20 of the housing 12. The vacuum pump 38 is in fluid communication with drum assembly 22 to create a vacuum in the drum assembly 22 to draw moisture out of the clothes in the tumbling drum 30. The vacuum pump 38 is in fluid communication with the sealed drum. A drain pipe 40 is coupled to the vacuum pump 38 and extends through the housing 12. The drain pipe 40 allows moisture and air vacuumed out of the drum assembly 22 to exit the housing 12.

A door 42 is hingedly coupled to the perimeter wall 18 of the housing 12 adjacent the hole 24. The door 42 is selectively positioned over the hole 24 to close the hole 24 and seal the drum assembly 22 from environmental communication. A generally transparent window 44 is positioned in the door 42 to permit viewing of the clothes in the drum assembly 22.

A control assembly 46 is electrically coupled to the vacuum pump 38 to control the vacuum pump 38 when the control assembly 46 is actuated. The control assembly 46 includes a processing unit 48 mounted to the housing 12 and positioned in the interior space 20. The processing unit 48 is in electrical communication with the vacuum pump 38. The processing unit 48 is in electrical communication with a power supply.

The control assembly 46 also includes a power button 50 coupled to the housing 12 to allow the power button 50 to be actuated. The power button 50 is in electrical communication with the processing unit 48 to control power to the processing unit 48 from the power supply when the power button 50 is actuated. A moisture sensor 52 is coupled to the vacuum pump 38 and electrically coupled to the processing unit 48. The moisture sensor 52 detects an amount of moisture in the air being removed from the drum assembly 22. The processing unit 48 shuts down the vacuum pump 38 when the moisture sensor 52 detects a moisture level in the air below a predetermined level.

A heating element 54 is electrically coupled to the control assembly 46 and in thermal communication with the drum assembly 22. The heating element 54 is supplied power from the control assembly 46 to heat the drum assembly 22 and maintain a predetermined temperature in the drum assembly 22.

A drive assembly 56 is mounted to the housing 12 and positioned in the interior space 20. The drive assembly 56 is electrically coupled to the control assembly 46 to control activation of the drive assembly 56. The drive assembly 56 is operationally coupled to the drum assembly 22 to actuate the drum assembly 22. The drive assembly 56 includes a motor 58 mounted to the housing 12. A drive disk 60 is rotatably mounted to the housing 12. The drive disk 60 is aligned with the drum assembly 22. The drive disk 60 is operationally coupled to the motor 58. The motor 58 rotates the drive disk 60 when the motor 58 is actuated.

The drive assembly 56 also includes a plurality of drive magnets 62 coupled to the drive disk 60. The drive magnets 62 are positioned between the drive disk 60 and the drum assembly 22. A plurality of drum magnets 64 is coupled to the tumbling drum 30. The drum magnets 64 are magnetically influenced by the drive magnets 62 to rotate the tumbling drum 30 when the drive disk 60 is rotated.

In use, the door 42 is opened and the clothes are placed into the tumbling drum 30. The door 42 is closed and the power button 50 is pressed. The motor 58 turns the drive disk 60 which turns the tumbling drum 30 to tumble the clothes. The vacuum pump 38 vacuums the air and moisture out of the drum assembly 22. The control assembly 46 provides power to the heating element 54 to maintain a predetermined temperature of the drum assembly 22. The moisture sensor 52 senses the air passing through the vacuum pump 38. When the moisture sensor 52 senses the amount of moisture in the air is below a predetermined level the control assembly 46 turns off the vacuum pump 38, the heating element 54 and the drive assembly 56.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clothes drying device for drying clothes, said device comprising:

a housing being positioned on a support surface, said housing including a top wall, a bottom wall and a perimeter wall extending between said bottom wall and said top wall to define an interior space of said housing;

a drum assembly being mounted in said interior space of said housing, said drum assembly receiving the clothes to be dried, a hole in said perimeter wall of said housing being in communication with said drum assembly to allow the clothes to be placed in said drum assembly, said drum assembly including a sealed chamber being positioned in said interior space of said housing, said sealed chamber being mounted to said perimeter wall of said housing and extending into said interior space from said perimeter wall, said vacuum pump being in fluid communication with said sealed drum;

a tumbling drum being positioned in said sealed chamber and extending around said hole, said tumbling drum being rotatably mounted to said sealed chamber, said tumbling drum receiving the clothes to be dried through said hole, said tumbling drum having a plurality of apertures extending therethrough to permit fluid communication with said sealed chamber;

a vacuum pump being mounted in said interior space of said housing, said vacuum pump being in fluid communication with drum assembly to create a vacuum in said drum assembly to draw moisture out of the clothes in said drum assembly;

a control assembly being electrically coupled to said vacuum pump to control said vacuum pump when said control assembly is actuated;

a drive assembly being mounted to said housing and positioned in said interior space, said drive assembly being electrically coupled to said control assembly to control activation of said drive assembly, said drive assembly being operationally coupled to said drum assembly to actuate said drum assembly, said drive assembly including;

motor being mounted to said housing;

a drive disk being rotatably mounted to said housing, said drive disk being aligned with said drum assembly, said drive disk being operationally coupled to said motor, said motor rotating said drive disk when said motor is actuated;

a plurality of drive magnets being coupled to said drive disk, said drive magnets being positioned between said drive disk and said drum assembly; and a plurality of drum magnets being coupled to said drum assembly, said drum magnets being magnetically influenced by said drive magnets to rotate a portion of said drum assembly when said drive disk is rotated.

2. The device according to claim 1, wherein said drum assembly includes a plurality of tumbling bars being coupled to an interior surface of said tumbling drum, said tumbling bars extending along a length of said tumbling drum, said tumbling bars impacting and tumbling the clothes in said tumbling drum when said tumbling drum is rotated.

3. The device according to claim 1, further comprising a drain pipe being coupled to said vacuum pump and extending through said housing, said drain pipe allowing moisture and air vacuumed out of said drum assembly to exit said housing.

4. The device according to claim 1, further comprising a door being hingedly coupled to said perimeter wall of said housing adjacent said hole, said door being selectively positioned over said hole to close said hole and seal said drum assembly from environmental communication.

5. The device according to claim 4, further comprising a window being positioned in said door to permit viewing of the clothes in said drum assembly.

6. The device according to claim 1, wherein said control assembly includes a processing unit being mounted to said housing and positioned in said interior space, said processing unit being in electrical communication with said vacuum pump, said processing unit being in electrical communication with a power supply.

7. The device according to claim 6, wherein said control assembly includes a power button being coupled to said housing to allow said power button to be actuated, said power button being in electrical communication with said processing unit to control power to said processing unit from the power supply when said power button is actuated.

8. The device according to claim 6, wherein said control assembly includes a moisture sensor being coupled to said vacuum pump and electrically coupled to said processing unit, said moisture sensor detecting an amount of moisture in the air being removed from said drum assembly, said processing unit shutting down said vacuum pump when said moisture sensor detects a moisture level in the air below a predetermined level.

9. The device according to claim 1, further comprising a heating element being electrically coupled to said control assembly and in thermal communication with said drum assembly, said heating element being supplied power from said control assembly to heat said drum assembly and maintain a predetermined temperature in said drum assembly.

10. A clothes drying device for drying clothes, said device comprising:

a housing being positioned on a support surface, said housing including a top wall, a bottom wall and a perimeter wall extending between said bottom wall and said top wall to define an interior space of said housing;

a drum assembly being mounted in said interior space of said housing, said drum assembly receiving the clothes to be dried, a hole in said perimeter wall of said housing being in communication with said drum assembly to allow the clothes to be placed in said drum assembly, said drum assembly comprising;

a sealed chamber being positioned in said interior space of said housing, said sealed chamber being mounted to said perimeter wall of said housing and extending into said interior space from said perimeter wall, said sealed chamber extending into said interior space from a front wall of said perimeter wall;

a tumbling drum being positioned in said sealed chamber and extending around said hole, said tumbling drum being rotatably mounted to said sealed chamber, said tumbling drum receiving the clothes to be dried through said hole, said tumbling drum having a plurality of apertures extending therethrough to permit fluid communication with said sealed chamber;

a plurality of tumbling bars being coupled to an interior surface of said tumbling drum, said tumbling bars extending along a length of said tumbling drum, said tumbling bars impacting and tumbling the clothes in said tumbling drum when said tumbling drum is rotated;

a vacuum pump being mounted in said interior space of said housing, said vacuum pump being in fluid communication with drum assembly to create a vacuum in said drum assembly to draw moisture out of the clothes in said tumbling drum, said vacuum pump being in fluid communication with said sealed drum;

a drain pipe being coupled to said vacuum pump and extending through said housing, said drain pipe allowing moisture and air vacuumed out of said drum assembly to exit said housing;

a door being hingedly coupled to said perimeter wall of said housing adjacent said hole, said door being selectively positioned over said hole to close said hole and seal said drum assembly from environmental communication;

a window being positioned in said door to permit viewing of the clothes in said drum assembly;

a control assembly being electrically coupled to said vacuum pump to control said vacuum pump when said control assembly is actuated, said control assembly comprising;

a processing unit being mounted to said housing and positioned in said interior space, said processing unit being in electrical communication with said vacuum pump, said processing unit being in electrical communication with a power supply;

a power button being coupled to said housing to allow said power button to be actuated, said power button being in electrical communication with said processing unit to control power to said processing unit from the power supply when said power button is actuated;

a moisture sensor being coupled to said vacuum pump and electrically coupled to said processing unit, said moisture sensor detecting an amount of moisture in the air being removed from said drum assembly, said processing unit shutting down said vacuum pump when said moisture sensor detects a moisture level in the air below a predetermined level;

a heating element being electrically coupled to said control assembly and in thermal communication with said drum assembly, said heating element being supplied power from said control assembly to heat said drum assembly and maintain a predetermined temperature in said drum assembly;

a drive assembly being mounted to said housing and positioned in said interior space, said drive assembly being electrically coupled to said control assembly to control activation of said drive assembly, said drive assembly being operationally coupled to said drum assembly to actuate said drum assembly, said drive assembly comprising;

a motor being mounted to said housing;

a drive disk being rotatably mounted to said housing, said drive disk being aligned with said drum assembly, said drive disk being operationally coupled to said motor, said motor rotating said drive disk when said motor is actuated;

a plurality of drive magnets being coupled to said drive disk, said drive magnets being positioned between said drive disk and said drum assembly; and a plurality of drum magnets being coupled to said tumbling drum, said drum magnets being magnetically influenced by said drive magnets to rotate said tumbling drum when said drive disk is rotated.

* * * * *